US005110489A

United States Patent [19]

Stadler et al.

[11] Patent Number: 5,110,489

[45] Date of Patent: May 5, 1992

[54] WATER RESISTANT GREASE COMPOSITION

[75] Inventors: James F. Stadler, Bethel Park; David L. Kufen, West Mifflin; James L. Purvis, Natrona Heights, all of Pa.

[73] Assignee: Exxon Research and Engineering Company, Florham Park, N.J.

[21] Appl. No.: 371,951

[22] Filed: Jun. 27, 1989

[51] Int. Cl.[5] ..... C01M 157/04

[52] U.S. Cl. ..... 252/35; 252/38; 252/51.5 A

[58] Field of Search ..... 252/17, 51.5 A, 35, 252/38

[56] References Cited

U.S. PATENT DOCUMENTS

| | | | |
|---|---|---|---|
| 3,189,543 | 6/1965 | Criddle | 252/18 |
| 3,392,117 | 7/1968 | Glasson | 252/17 |
| 3,412,027 | 11/1968 | Morway | 252/40.7 |
| 3,553,125 | 1/1971 | Watters | 260/23.7 |
| 4,517,104 | 5/1985 | Bloch et al. | 252/47.5 |
| 4,664,676 | 5/1987 | Denis et al. | 44/62 |
| 4,676,917 | 5/1987 | Sung et al. | 252/51.5 A |
| 4,720,350 | 1/1988 | Zoleski | 252/51.5 A |
| 4,731,095 | 5/1988 | Garapon et al. | 44/62 |
| 4,749,500 | 6/1988 | Forsberg et al. | 252/493 |
| 4,764,304 | 8/1988 | Kapuscinski et al. | 252/51.5 |
| 4,803,003 | 2/1989 | Chung | 252/51.5 A |
| 4,804,794 | 2/1989 | Ver Strate et al. | 585/352 |

FOREIGN PATENT DOCUMENTS

| | | |
|---|---|---|
| 3508978 | 8/1978 | Australia . |
| 0084910 | 8/1983 | European Pat. Off. . |

OTHER PUBLICATIONS

Smalheer et al., Lubricant Additives, pp. 1-11, 1967.

*Primary Examiner*—Prince Willis, Jr.
*Assistant Examiner*—E. McAvoy
*Attorney, Agent, or Firm*—John W. Ditsler

[57] ABSTRACT

A grease composition having impoved water resistance is disclosed. More specifically, the addition of a copolymer of ethylene and at least one other alpha-olefin monomer and an ethylene copolymer having an amine functionality to a base grease comprising a lubricating oil and a water insoluble thickener results in a grease composition which has excellent water resistance. In a preferred embodiment, polyisoprene is added to obtain a further improvement in water resistance.

38 Claims, No Drawings

WATER RESISTANT GREASE COMPOSITION

CROSS-REFERENCE TO RELATED APPLICATIONS

This application is related to a copending application entitled "Water Resistant Grease Composition", filed on the same date herewith.

BACKGROUND OF THE INVENTION

1. Field of the Invention

This invention relates to a grease composition having improved water resistance and to its method of preparation.

2. Description of Related Art

The use of polymers to impart desirable properties to greases is known and widely practiced by grease manufacturers (see E. N. Klemgard, *Lubricating Greases* (1937) and C. J. Boner, *Manufacture and Application of Lubricating Greases* (1954)). For example, oil soluble polymers have been used to increase the viscosity of the lubricating oil in the grease, thereby resulting in a grease having enhanced structural stability, reduced oil separation, and increased water resistance. However, although these benefits could be obtained without polymers using lubricating oils having high viscosity basestocks, the resulting debit on low temperature mobility (i.e. pumpability) severely limits a non-polymer approach.

In addition, a recent publication (see G. D. Hussey, "Alternation of Grease Characteristics with New Generation Polymers", NLGI Spokesman, August 1987) compared the performance of commonly used polymers in various greases. However, none of the compositions mentioned in these references teach or suggest the water resistance grease composition described hereinafter.

SUMMARY OF THE INVENTION

This invention concerns a grease composition having improved water resistance due to the addition of certain oil soluble ethylene copolymers. More specifically, a grease composition comprising (1) a lubricating oil, (2) a water insoluble thickener, (3) a copolymer of ethylene and at least one other alpha-olefin monomer, and (4) an ethylene copolymer having an amine functionality has been found to have excellent water resistance. In a preferred embodiment, a further enhancement in water resistance is obtained by adding polyisoprene to the composition.

DETAILED DESCRIPTION OF THE INVENTION

The essential components of this invention are a lubricating oil, a water insoluble thickener, a copolymer of ethylene and at least one other alpha-olefin monomer, and an ethylene copolymer having amine functionality.

A wide variety of lubricating oils can be employed in preparing the grease composition of this invention. Accordingly, the lubricating oil base can be any of the conventionally used mineral oils, synthetic hydrocarbon oils, or synthetic ester oils. In general, these lubricating oils will have a viscosity in the range of about 5 to about 5,000 cSt at 40° C., although typical applications will require an oil having a viscosity ranging from about 25 to about 2,000 cSt at 40° C. Mineral lubricating oil base stocks used in preparing the lubricating composition can be any conventionally refined base stocks derived from paraffinic, naphthenic, and mixed base crudes. Synthetic lubricating oils that can be used include esters of dibasic acids such as di-2-ethylhexyl sebacate, esters of glycols such as a $C_{13}$ oxo acid diester of tetraethylene glycol, or complex esters such as the ester formed from 1 mole of sebacic acid, 2 moles of tetraethylene glycol, and 2 moles of 2-ethylhexanoic acid. Other synthetic oils that can be used include synthetic hydrocarbons such as polyalphaolefins; alkyl benzenes (e.g., alkylate bottoms from the alkylation of benzene with tetrapropylene, or the copolymers of ethylene and propylene silicon oils, e.g., ethyl phenyl polysiloxanes, methyl polysiloxanes, etc.); polyglycol oils (e.g., those obtained by condensing butyl alcohol with propylene oxide); and carbonate esters (e.g., the product of reacting $C_8$ oxo alcohol with ethyl carbonate to form a half ester followed by reaction of the latter with tetraethylene glycol, etc.). Other suitable synthetic oils include the polyphenyl ethers, e.g., those having from about 3 to 7 ether linkages and about 4 to 8 phenyl groups. (See U.S. Pat. No. 3,424,678, column 3.) Normally, the lubricating oil will comprise a major amount of the grease composition. Typically, the amount of lubricating oil will range from above about 50 to about 90 wt. %, preferably from about 70 to about 85 wt. %, of the grease composition.

The grease composition will also contain a thickener dispersed in the lubricating oil to form a base grease. However, the particular thickener employed is not critical and can vary broadly provided it is essentially water insoluble. For example, the thickener may be based on aluminum, barium, calcium, lithium soaps, or their complexes. Soap thickeners may be derived from a wide range of animal oils, vegetable oils, and greases as well as the fatty acids derived therefrom. These materials are well known in the art and are described in, for example, C. J. Boner, Manufacture and Application of Lubricating Greases, Chapter 4, Robert E. Krieger Publishing Company, Inc., New York (1971). Carbon black, silica, and clays may be used as well as dyes, polyureas, and other organic thickeners. Pyrrolidone based thickeners can also be used. Preferred thickeners are based on lithium soap, calcium soap, their complexes, or mixtures thereof. Particularly preferred is a lithium or lithium complex thickener that incorporates an hydroxy fatty acid having from 12 to 24 (preferably from 16 to 20) carbon atoms. A preferred hydroxy fatty acid is an hydroxy stearic acid (e.g., a 9-hydroxy or a 10-hydroxy stearic acid) of which 12-hydroxy stearic acid is most preferred (See U.S. Pat. No. 3,929,651, the disclosure of which is incorporated herein by reference). The amount of thickener in the lubricating composition will typically range from about 1 to about 15 wt. %. For most purposes, between about 6 to about 12 wt. %, preferably between about 8 to about 10 wt. %, of the thickener will be present in the composition.

The grease composition will also contain a segmented copolymer of ethylene and at least one other alpha-olefin monomer. These copolymers, which are described in U.S. Pat. No. 4,804,794 (the disclosure of which is incorporated herein by reference), have a chain containing at least one crystallizable segment of ethylene monomer units and at least one low crystallinity ethylene-alpha-olefin copolymer segment, wherein the low crystallinity copolymer segment is characterized in the unoriented bulk state after at least 24 hours annealing by a degree of crystallinity of less than about 0.2% at 23° C., and wherein the copolymer's chain is intramolecularly heterogeneous and intermolecularly homogeneous, and has a molecular weight distribution (MWD) characterized by at least one of $\overline{M}_w/\overline{M}_n$ of less than 2 and $\overline{M}_z/\overline{M}_w$ of less than 1.8. $M_w$, $M_n$, and $M_z$ refer to the weight-, number-, and Z-average molecular weight as those terms are defined in U.S. Pat. No. 4,804,794. The crystallizable segments comprise from about 10 to 90 wt. %, preferably from about 20 to 85 wt. %, and more preferably from about 40 to 65 wt. %, of the total copolymer chain, and contain an average ethylene content which is at least about 57 wt. %, preferably at least about 62 wt. %, more preferably at least about 60 wt. %, and most preferably at least about 63 wt. %, and which is not greater than 95 wt. %, more preferably <85%, and most preferably <75 wt. % .g., from about 50 to 68 wt. %). The low crystallinity copolymer segments comprise from about 90 to 10 wt. %, preferably from about 80 to 15 wt. %, and more preferably from about 65 to 35 wt. %, of the total copolymer chain, and contain an average ethylene content of from about 20 to 53 wt. %, preferably from about 30 to 50 wt. %, and more preferably from about 35 to 50 wt. %. The copolymers comprise intramolecularly heterogeneous chain segments wherein at least two portions of an individual intramolecularly heterogeneous chain, each portion comprising at least 5 wt. % of the chain and having a molecular weight of at least 7000 and contain at least 5 wt. % ethylene and differ in composition from one another by at least 5 wt. % ethylene, wherein the intermolecular compositional dispersity of the polymer is such that 95 wt. % of the polymer chains have a composition 15% or less different in ethylene from the average wt. % ethylene composition, and wherein the copolymer is characterized by at least one or a ratio of $\overline{M}_w/\overline{M}_n$ of less than 2 and a ratio of $\overline{M}_z/\overline{M}_w$ of less than 1.8.

These copolymers will contain at least one crystallizable segment rich in methylene units (hereinafter called an "M" segment) and at least one low crystallinity ethylene-alpha-olefin copolymer segment (hereinafter called a "T" segment). Therefore, the copolymers may be illustrated by copolymers selected from the group consisting of copolymer chain structures having the following segment sequences:

$$M\text{-}T \quad \text{(I)}$$

$$T^1\text{-}(M\text{-}T^2)x, \text{ and} \quad \text{(II)}$$

$$T^1\text{-}(M^1\text{-}T^2)y\text{-}M^2 \quad \text{(III)}$$

wherein M and T are defined above, $M^1$ and $M^2$ can be the same or different and are each M segments, $T^1$ and $T^2$ can be the same or different and are each T segments, x is an integer of from 1 to 3 and y is an integer of 1 to 3.

In structure II(x=1), the copolymer's M segment is positioned between two T segments, and the M segment can be positioned substantially in the center of the polymer chain (that is, the $T^1$ and $T^2$ segments can be sustantially the same molecular weight and the sum of the molecular weight of the $T^1$ and $T^2$ segments can be substantially equal to the molecular weight of the M segment), although this is not essential. Preferably, the copolymer will contain only one M segment per chain. Therefore, structures I and II (x=1) are preferred.

Preferably, the M segments and T segments of the copolymer are located along the copolymer chain so that only a limited number of the copolymer chains can associate before the steric problems associated with packing the low crystallinity T segments prevents further agglomeration. Therefore, in a preferred embodiment, the M segment is located near the center of the copolymer chain and only one M segment is in the chain.

The M segments of the copolymers comprise ethylene and can also comprise at least one other alpha-olefin, e.g. containing 3 to 18 carbon atoms. The T segments comprise ethylene and at least one other alpha-olefin, e.g. alpha-olefins containing 3 to 18 carbon atoms. The M and T segments can also comprise other polymerizable monomers, e.g., non-conjugated dienes or cyclic mono-olefins.

Although the alpha-olefins could include those containing 3 to 18 carbon atoms (e.g., propylene, butene-1, pentene-1, etc.), alpha-olefins of 3 to 6 carbons are preferred due to economic considerations. The most preferred copolymers are those comprised of ethylene and propylene or ethylene, propylene and diene.

As is well known to those skilled in the art, copolymers of ethylene and higher alpha-olefins such as propylene often include other polymerizable monomers. Typical of these other monomers may be non-conjugated dienes such as the following non-limiting examples:

a. straight chain acyclic dienes such as: 1,4-hexadiene; 1,6-octadiene;

b. branched chain acyclic dienes such as: 5-methyl-1, 4-hexadiene; 3,7-dimethyl-1,6-octadiene; 3,7-dimethyl-7-octadiene, and the mixed isomers of dihydro-myrcene and dihydroocinene;

c. single ring alicyclic dienes such as: 1,4-cyclohexadiene; 1,5-cyclooctadiene; and 1,5-cyclododecadiene;

d. multi-ring alicyclic fused and bridged ring dienes such as: tetrahydroindene; methyltetrahydroindene; dicyclopentadiene; bicyclo-(2,2,1)-hepta-2,5-diene; alkenyl, alkylidene, cycloalkenyl and cycloalkylidene norbornenes such as 5-methylene-2-norbornene (MNB), 5-ethylidene-2-norbornene (ENB), 5-propylene-2-norbornene, 5-isopropylidene-2-norbornene, 5-(4-cyclopentenyl)-2-norbornene; 5-cyclohexylidene-2-norbornene.

Of the non-conjugated dienes typically used to prepare these copolymers, dienes containing at least one of the double bonds in a strained ring are preferred. The most preferred diene is 5-ethylidene-2-norbornene (ENB). The amount of diene (wt. basis) in the copolymer could be from about 0% to 20% with 0% to 15% being preferred. The most preferred range is 0% to 10%.

The average ethylene content of the copolymer could be as low as about 20% on a weight basis. The preferred minimum is about 25%. A more preferred minimum is about 30%. The maximum ethylene content could be about 90% on a weight basis. The preferred maximum is about 85%, with the most preferred being about 80%. Preferably, the copolymers contain from about 35 to 75 wt. % ethylene, and more preferably from about 50 to 70 wt. % ethylene.

The molecular weight of the copolymer can vary over a wide range. Although the weight-average molecular weight could be as low as about 2,000, the preferred minimum is about 10,000, with the most preferred minimum being about 20,000. Although the maximum weight-average molecular weight could be as high as about 12,000,000, the preferred maximum is about 1,000,000, with the most preferred maximum being about 750,000. An especially preferred range of weight-average molecular weight for copolymers is from 50,000 to 500,000.

The MWD of this copolymer is very narrow, as characterized by at least one of a ratio of $\overline{M}_w/\overline{M}_n$ of less than 2 and a ratio of $\overline{M}_z/\overline{M}_w$ of less than 1.8. A typical advantage of such copolymers having narrow MWD is resistance to shear degradation. The preferred copolymers have $\overline{M}_w/\overline{M}_n$ less than about 1.5, with less than about 1.25 being most preferred. The preferred $\overline{M}_z/\overline{M}_w$ is less than about 1.5, with less than about 1.2 being most preferred.

The amount of ethylene/other alpha-olefin copolymer added need only be that which (in combination with the ethylene copolymer having amine functionality) improves the water resistance of the grease. Typically, however, the amount of copolymer will range from about 0.01 to about 4 wt. % (preferably from about 0.1 to about 2 wt. %) based on total weight of the grease.

The grease composition will also contain an ethylene copolymer having amine functionality. By "amine functionality" is meant the oil soluble ethylene copolymers described in U.S. Pat. No. 4,517,104, the disclosure of which is incorporated herein by reference. In general, these oil soluble ethylene copolymers will have a number average molecular weight ($\overline{M}_n$) of from about 5000 to about 500,000; preferably 10,000 to 200,000, and optimally from about 20,000 to 100,000. These polymers will generally have a narrow range of molecular weight, as determined by the ratio of weight average molecular weight ($\overline{M}_w$) to number average molecular weight ($\overline{M}_n$). Polymers having a $\overline{M}_w/\overline{M}_n$ of less than 10, preferably less than 7, and more preferably 4 or less are most desirable. As used herein ($\overline{M}_n$) and (e,ovs/M/ $_w$) are measured by the well known techniques of vapor phase osmometry (VPO), membrane osmometry, and gel permeation chromotography.

These polymers are prepared from ethylene and ethylenically unsaturated hydrocarbons including cyclic, alicyclic and acyclic, containing from 3 to 28 carbons, e.g. 2 to 18 carbons. The ethylene copolymers may contain from about 15 to about 90 wt. %, preferably from about 30 to about 80 wt. %, ethylene and from about 10 to about 85 wt. %, preferably from about 20 to about 70 wt. %, of one or more $C_3$ to $C_{28}$, preferably $C_3$ to $C_{18}$, more preferbly $C_3$ to $C_8$, alpha olefins. While not essential, such copolymers preferably have a degree of crystallinity of less than 25 wt. %, as determined by X-ray and differential scanning calorimetry. Copolymers of ethylene and propylene are most preferred. Other alpha-olefins suitable in place of propylene to form the copolymer, or to be used in combination with ethylene and propylene, to form a terpolymer, tetrapolymer, etc., include 1-butene, 1-pentene, 1hexene, 1-heptene, 1-octene, 1-nonene, 1-decene, etc.; also branched chain alpha-olefins such as 4-methyl-1-pentene, 4-methyl-1-hexene, 5-methylpentene-1, 4,4-dimethyl-1-pentene, and 6-methyl-heptene-1, etc., and mixtures thereof.

The term copolymer as used herein, unless otherwise indicated, includes terpolymers, tetrapolymers, etc., of ethylene, said $C_{3-28}$ alpha-olefin and/or a non-conjugated diolefin or mixtures of such diolefins which may also be used. The amount of the non-conjugated diolefin will generally range from about 0.5 to 20 mole percent, preferably about 1 to about 7 mole percent, based on the total amount of ethylene and alpha-olefin present.

Representative examples of non-conjugated dienes that may be used as the third monomer in the terpolymer include:

a. Straight chain acyclic dienes such as: 1,4-hexadiene; 1,5-heptadiene; 1,6-octadiene.

b. Branched chain acyclic dienes such as: 5-methyl-1,4-hexadiene; 3,7-dimethyl 1,6-octadiene; 3,7-dimethyl 1,7-octadiene; and the mixed isomers of dihydro-myrcene and dihydro-cymene.

c. Single ring alicyclic-dienes such as: 1,4-cyclohexadiene; 1,5-cyclooctadiene; 1,5-cyclododecadiene; 4-vinylcyclohexene; 1-allyl, 4-isopropylidene cyclohexane; 3-allyl-cyclopentene; 4-allyl cyclohexene and 1-isopropenyl-4-(4-butenyl)cyclohexane.

d. Multi-single ring alicyclic dienes such as: 4,4'-dicyclopentenyl and 4,4'-dicyclohexenyl dienes.

e. Multi-ring alicyclic fused and bridged ring dienes such as: tetrahydroindene; methyl tetrahydroindene; dicyclopentadiene; bicyclo(2.2.1)hepta 2,5-diene; alkyl, alkenyl, alkylidene, cycloalkenyl and cycloalkylidene norbornenes such as: ethyl norbornene; 5-methylene-6-methyl-2-norbornene; 5-methylene-6, 6-dimethyl-2-norbornene; 5-propenyl-2-norbornene 5-(3-cyclopentenyl)-2-norbornene and 5-cyclohexylidene-2-norbornene; norbornadiene; etc.

Ethylenically unsaturated carboxylic acid materials which are grafted (attached) onto the ethylene copolymer contain at least one ethylenic bond and at least one, preferably two, carboxylic acid groups, or an anhydride group, or a polar group which can be converted into said carboxyl groups by oxidation or hydrolysis. Maleic anhydride or a derivative thereof is preferred because it does not appear to homopolymerize appreciably but grafts onto the ethylene copolymer to give two carboxylic acid functionalities. Such preferred materials have the general formula

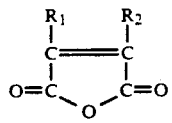

wherein $R_1$ and $R_2$ are hydrogen or a halogen. Suitable examples additionally include chloro-maleic anhydride, itaconic anhydride, or the corresponding dicarboxylic acids, such as maleic acid or fumaric acid or their monoesters, etc.

As taught by U.S. Pat. Nos. 4,160,739 and 4,161,452, various unsaturated comonomers may be grafted on the olefin copolymer together with the unsaturated acid component, e.g. maleic anhydride. Such graft monomer systems may comprise one or a mixture of comonomers different from the unsaturated acid component and which contain only one copolymerizable double bond and are copolymerizable with said unsaturated acid component. Typically, such comonomers do not contain free carboxylic acid groups and are esters containing $\alpha,\beta$-ethylenic unsaturation in the acid or alcohol portion; hydrocarbons, both aliphatic and aromatic, containing $\alpha,\beta$-ethylenic unsaturation, such as the $C_4$–$C_{12}$ alpha olefins, for example isobutylene, hexene, nonene, dodecene, etc.; styrenes, for example styrene, $\alpha$-methyl styrene, p-methyl styrene, p-sec. butyl styrene, etc.; and vinyl monomers, for example vinyl acetate, vinyl chloride, vinyl ketones such as methyl and ethyl vinyl ketone, etc. Comonomers containing functional groups which may cause crosslinking, gelation or other interfering reactions should be avoided, although minor amounts of such comonomers (up to about 10% by weight of the comonomer system) often can be tolerated.

Specific useful copolymerizable comonomers include the following:

(A) Esters of saturated acids and unsaturated alcohols wherein the saturated acids may be monobasic or polybasic acids containing up to about 40 carbon atoms such as the following: acetic, propionic, butyric, valeric, caproic, stearic, oxalic, malonic, succinic, glutaric, adipic, pimelic, suberic, azelaic, sebacic, phthalic, isophthalic, terephthalic, hemimellitic, trimellitic, trimesic and the like, including mixtures. The unsaturated alcohols may be monohydroxy or polyhydroxy alcohols and may contain up to about 40 carbon atoms, such as the following: allyl, methally, crotyl, 1-chloroallyl, 2-chloroallyl, cinnamyl, vinyl, methyl vinyl, 1-phenallyl, butenyl, propargyl, 1-cyclohexene-3-ol, oleyl, and the like, including mixtures.

(B) Esters of unsaturated monocarboxylic acids containing up to about 12 carbon atoms such as acrylic, methacrylic and crotonic acid, and an esterifying agent containing up to about 50 carbon atoms, selected from saturated alcohols and alcohol epoxides. The satuarted alcohols may preferably contain up to about 40 carbon atoms and include monohydroxy compounds such as: methanol, ethanol, propanol, butanol, 2-ethylhexanol, octanol, dodecanol, cyclohexanol, cyclopentanol, neopentyl alcohol, and benzyl alcohol; and alcohol ethers such as the monomethyl or monobutyl ethers of ethylene or propylene glycol, and the like, including mixtures. The alcohol epoxides include fatty alcohol epoxides, glycidol, and various derivatives of alkylene oxides, epichlorohydrin, and the like, including mixtures.

The components of the graft copolymerizable system are used in a ratio of unsaturated acid monomer component to comonomer component of about 1:4 to 4:1, preferably about 1:2 to 2:1 by weight.

The grafting of the ethylene copolymer with the carboxylic acid material may be by any suitable method, such as thermally by the "ene" reaction, using copolymers containing unsaturation, such as ethylene-propylene-diene polymers either chlorinated or unchlorinated, or more preferably it is by free-radical induced grafting in solvent, preferably in a mineral lubricating oil as solvent.

The radical grafting is preferably carried out using free radical initiators such as peroxides, hydroperoxides, and azo compounds and preferably those which have a boiling point greater than about 100° C. and which decompose thermally within the grafting temperature range to provide said free radicals. Representative of these free-radical initiators are azobutyro-nitrile, 2,5-dimethyl-hex-3-yne-2, 5 bis-tertiary-butyl peroxide (sold as Lupersol 130) or its hexane analogue, di-tertiary butyl peroxide and dicumyl peroxide. The initiator is generally used at a level of between about 0.005% and about 1%, based on the total weight of the polymer solution, and temperatures of about 150° to 220° C.

The ethylenically unsaturated carboxylic acid material, preferably maleic anhydride, will be generally used in an amount ranging from about 0.01% to about 10%, preferably 0.1 to 2.0%, based on weight of the initial total solution. The aforesaid carboxylic acid material and free radical initiator are generally used in a weight percent ratio range of 1:1 to 30:1, preferably 3:1 to 6:1.

The amine component will have two or more primary amine groups, wherein the primary amine groups may be unreacted, or wherein one of the amine groups may already be reacted.

Particularly preferred amine compounds have the following formulas:

(A) alkylene polyamines

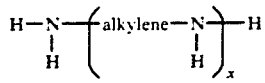

wherein x is an integer of about 1 to 10, preferably about 2 to 7, and the alkylene radical is a straight or branched chain alkylene radical having 2 to 7, preferably about 2 to 4, carbon atoms;

(B) polyoxyalkylene polyamines $$NH_2\text{—alkylene}\text{—O—alkylene}\rangle_m NH_2 \quad \text{(i)}$$

where m has a value of about 3 to 70, preferably 10 to 35; and $$R\langle\text{alkylene}\text{—O—alkylene}\rangle_n NH_2)_{3-6} \quad \text{(ii)}$$

where n has a value of about 1 to 40 with the provision that the sum of all the n's is from about 3 to about 70, preferably from about 6 to about 35, and R is a polyvalent saturated hydrocarbon radical of up to ten carbon atoms having a valence of 3 to 6. The alkylene groups in either formula (i) or (ii) may be straight or branched chains containing about 2 to 7, preferably about 2 to 4, carbon atoms.

Examples of the alkylene polyamines of formula (A) above include methylene amines, ethylene amines, butylene amines, propylene amines, pentylene amines, hexylene amines, heptylene amines, octylene amines, other polymethylene amines, the cyclic and higher homologs of these amines such as the piperazines, the amino-alkyl-substituted piperazines, etc. These amines include, for example, ethylene diamine, diethylene triamine, triethylene tetramine, propylene diamine, di(-heptamethylene)triamine, tripropylene tetramine, tetraethylene pentamine , trimethylene diamine, pentaethylene hexamine, di(trimethylene)triamine, 2-heptyl-3-(2-aminopropyl)imidazoline, 4-methylimidazoline, 1,3-bis(2-aminoethyl)imidazoline, pyrimidine, 1-(2-aminopropyl)piperazine, 1,4-bis-(2-aminoethyl)piperazine, N,N-dimethyaminopropyl amine, N,N-dioctylethyl amine, N-octyl-N'-methylethylene diamine, 2-methyl-1-(3-aminobutyl)piperazine, etc. Other higher homologs which may be used can be obtained by condensing two or more of the above-mentioned alkylene amines in a known manner.

The ethylene amines which are particularly useful are described, for example, in the Encyclopedia of Chemical Technology under the heading of "Ethylene Amines" (Kirk and Othmer), Volume 5, pgs. 898-905; Interscience Publishers, New York (1950).

The polyoxyalkylene polyamines of formula (B) above, preferably polyoxyalkylene diamines and polyoxyalkylene triamines, may have average molecular weights ranging from about 200 to about 4000 and preferably from about 400 to about 2000. The preferred polyoxyalkylene polyamines include the polyoxyethylene and polyoxypropylene diamines and the polyoxypropylene triamines having average molecular weights ranging from about 200 to 2000. The polyoxyalkylene polyamines are commercially available and may be obtained, for examples, from the Jefferson Chemical Company, Inc. under the trade name "Jeffamines D-230, D-400, D-1000, D-2000, T-403", etc.

The acid component includes: hydrocarbyl substituted succinic anhydride or acid having 12 to 49 carbons, preferably 16 to 49 carbons in said hydrocarbyl group; long chain monocarboxylic acid of the formula RCOOH where R is a hydrocarbyl group of 50 to 400 carbons and long chain hydrocarbyl substituted succinic anhydride or acid having 50 to 400 carbons in said hydrocarbyl group. Said hydrocarbyl groups are essentially aliphatic and include alkenyl and alkyl groups. The longer chain acids and anhydrides are preferred, particularly when the grafting reaction is carried out in lubricating oil because of its ability to impart dispersancy to reacted oil molecules as well as their greater solubilizing effect.

Primarily because of its ready availability and low cost, the hydrocarbyl portion (e.g. alkenyl groups) of the carboxylic acid or anhydride is preferably derived from a polymer of a $C_2$ to $C_5$ monoolefin, said polymer generally having a molecular weight of about 140 to 6500, e.g. 700 to about 5000, most preferably 700 to 3000 molecular weight. Particularly preferred is polyisobutylene.

The aforesaid amine and acid component may be prereacted, with the acid being generally attached to the amine through salt, imide, amide, amidine, ester, or other linkages so that a primary amine group of the polyamine is still available for reaction with the acid moieties of the grafted polymer.

The amount of the ethylene copolymer containing amine functionality in the grease composition need only be that which (in combination with the ethylene copolymer without amine functionality) improves the water resistance of the grease. Typically, however, the amount of ethylene copolymer containing amine functionality will range from about 0.01 to about 4 wt. %, preferably from about 0.1 to about 2 wt. %, based on weight of the grease.

In a preferred embodiment, polyisoprene is added to the grease composition thus described to obtain a further improvement in water resistance. The amount of polyisoprene added need only be a water resistance improving amount. Typically, however, the amount of polyisoprene added will range from about 0.1 to about 0.4 wt. %, preferably from about 0.1 to about 0.2 wt. %, based on total weight of the grease.

The particular polymers employed in this invention can be readily obtained in the marketplace. As such, their methods of preparation are well known to those skilled in the art (also see U.S. Pat. Nos. 4,517,104 and 4,804,794).

The grease composition may also contain small amounts of supplemental additives which include, but are not limited to, anticorrosive agents, extreme pressure antiwear agents, pour point depressants, tackiness agents, oxidation inhibitors, dyes, and the like, which are incorporated for specific purposes. The total amount of these additives will typically range from about 2 to about 5 wt. % based on total weight of the grease composition. In addition, solid lubricants such as molybdenum disulfide and graphite may be present in the composition—typically from about 1 to about 5 wt. % (preferably from about 1.5 to about 3 wt. %) for molybdenum disulfide and from about 3 to about 15 wt. % (preferably from about 6 to about 12 wt. %) for graphite.

The grease composition of this invention is usually prepared in situ by chemically reacting or mechanically dispersing thickener components in the lubricating oil for from about 1 to about 8 hours or more (preferably from about 3 to about 6 hours) followed by heating at elevated temperature (e.g., from about 140° to about 225° C. depending upon the particular thickener used) until the mixture thickens. In some cases (e.g. a simple lithium grease), a preformed thickener can be used. The mixture is then cooled to ambient temperature (typically about 60° C.) during which time the one or more of the ethylene copolymers disclosed herein and other additives are added. These copolymers and the other additives can be added together or separately in any order. However, the polyisoprene must be added to the grease after milling all of the other components. The product should not be milled after addition of the polyisoprene.

The components of the grease composition can be mixed, blended, or milled in any number of ways which can readily be selected by one skilled in the art. Suitable means include external mixers, roll mills, internal mixers, Banbury mixers, screw extruders, augers, colloid mills, homogenizers, and the like.

The grease composition of this invention may be suitably employed in essentially any application requiring good water resistance. Examples of such applications include steel mills, underground mining, and the like. The composition, however, is particularly well suited for use in steel mill applications.

This invention will be further understood by reference to the following examples which are not intended to restrict the scope of the claims appended hereto.

EXAMPLE 1

Water Spray-off of a Lithium Grease Containing an Ethylene-Propylene Copolymer A simple lithium base grease was prepared using a lithium 12 hydroxy stearate soap dispersed in 30% of the base oil. After dispersing the soap, additional oil is added to reach the proper consistency. About 0.3 wt. % of ethylene-propylene copolymer physically admixed with ethylene vinyl acetate was then added to the base grease together with conventional grease additives (e.g. antiwear, antirust, extreme pressure agents, etc.). The copolymer contained about 56 wt. % ethylene and had an average molecular weight of about 180,000. The resulting product was then milled in a Charlotte mill for about 4 hours. The water spray-off (a measure of water resistance) of the milled product was determined to be 50% (an average of 48% and 52% on two tests) using ASTM D 4049, the disclosure of which is incorporated herein by reference.

EXAMPLE 2

Water Spray-Off of the Grease of Example 1 Containing an Ethylene-Propylene Copolymer Having Amine Functionality Example 1 was repeated except that 0.3 wt. % of the ethylene-propylene copolymer/EVA admixture and 0.3 wt. % of an ethylene-propylene copolymer having amine functionality with an ethylene content of about 44 wt. % and an weight average molecular weight estimated to range from about 140,000 to about 150,000. After milling for 4 hours, the water spray-off of the product was measured to be 30% (an average of 27%, 31%, and 33% on three tests).

EXAMPLE 3

Water Spray-Off of the Grease of Example 2 Containing Polyisoprene

Example 2 was repeated except that 0.1 wt. % polyisoprene was added to the grease mixture. The product was not milled after adding the polyisoprene. The water spray-off of the grease was measured to be 16%.

EXAMPLE 4

Water Spray-Off of a Lithium Grease Containing an Ethylene-Propylene Copolymer Example 1 was repeated using 0.5 wt. % of the polymer. The water spray-off of the resulting product was measured to be 46%.

Examples 1 and 2 show that a significant reduction in water spray-off (and an improvement in water resistance) is obtained when an ethylene-propylene copolymer having amine functionality is added to a grease already containing an ethylene-propylene copolymer. Example 3 shows that a further reduction in water spray-off is obtained when polyisoprene is added to the grease containing the two ethylene-propylene copolymers. Example 4 shows that the water spray-off of a grease containing the ethylene-propylene copolymer gave much poorer results than the grease of Example 2 which contained about the same total amount of polymer.

What is claimed is:

1. A grease composition which comprises (a) from about 50 to about 90 wt. % of a lubricating oil, (b) from about 1 to about 15 wt. % of a water insoluble thickener, and (c) from about 0.01 to about 4 wt. % of a copolymer of ethylene and at least one other alphaolefin monomer, wherein the copolymer comprises intramolecularly heterogeneous copolymer chains containing at least one crystallizable segment of the methylene units and at least one low crystallinity ethylene-alphaolefin copolymer segment, wherein said at least one crystallizable segment comprises at least about 10 wt. % of said copolymer chain and contains an average ethylene content of at least about 57 wt. %, wherein said low crystallinity segment contains an average ethylene content not greater than about 53 wt. %, and wherein aid copolymer has a molecular weight distribution characterized by at least one of a ratio of $\overline{M}_w/\overline{M}_n$ of less than 2 and a ratio of $\overline{M}_z/\overline{M}_w$ of less than 1.8, and wherein at least two portions of an individual intramolecularly heterogeneous chain, each portion comprising at least 5 wt. % of said chain, differ in composition from one another by at least 7 wt. % ethylene, and (d) from about 0.01 to about 4 wt. % of a copolymer that comprises the reaction product of (i) an ethylene copolymer comprising from about 15 to about 90 wt. % ethylene and from about 10 to about 85 wt. % of one or more $C_3$ to $C_{28}$ alpha-olefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;

(ii) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and, (iii) a long chain hydrocarbyl substituted succinic anhydride or acid having 50 to 400 carbon atoms.

2. The composition of claim 1 wherein the thickener is based on aluminum, barium, calcium, lithium soaps, or their complexes.

3. The composition of claim 2 wherein the thickener is based on a lithium soap, a calcium soap, their complexes, or mixtures thereof.

4. The composition of claim 1 wherein the composition also contains from about 0.1 to about 0.4 wt. % polyisoprene.

5. The composition of claim 1 wherein the copolymer in (c) has an intermolecular compositional dispersity such that 95 wt. % of the copolymer chains have a composition 10 wt. % or less different from said average ethylene composition.

6. The composition of claim 1 wherein the low crystallinity segment comprises an average ethylene content of from about 20 to 53 wt. %.

7. The composition of claim 1 wherein the copolymer in (c) is characterized by a weight-average molecular weight of from about 2,000 to about 12,000,000.

8. The composition of claim 1 wherein the copolymer in (c) has total maximum ethylene content of about 90 wt. %.

9. The composition of claim 8 wherein the copolymer in (c) has a total minimum ethylene content of about 20 wt. %.

10. The composition of claim 1 wherein the copolymer in (c) chain segment sequences are characterized by at least one of the structures:

$$M—T \quad (I)$$
$$T^1—(M—T^2)_x \quad (II)$$
$$T^1—(M^1—T^2)_yM^2 \quad (III)$$

wherein x and y are each integers of 1 to 3, M comprises said crystallizable segment, T comprises the low crystallinity segment, $M^1$ and $M^2$ are the same or different and each comprises an M segment, and $T^1$ and $T^2$ are the same or different and each comprises a T segment.

11. The composition of claim 10 wherein x is one.

12. The composition of claim 1 wherein the reaction product is formed by simultaneously reacting (i), (ii), and (iii) with removal of water.

13. The composition of claim 12 wherein (ii) and (iii) are first pre-reacted followed by reaction with (i).

14. The composition of claim 12 wherein (i) comprises a copolymer containing from about 30 to about 80 wt. % ethylene and from about 20 to about 70 wt. % propylene, having a number average molecular weight in the range of about 10,000 to 200,000 grafted with maleic anhydride.

15. The composition of claim 14 wherein (i) comprises ethylene and propylene grafted with maleic anhydride, wherein about 1 to 2 molar proportions of (ii) and about 1 to 4 molar proportions of (iii) are used per molar proportion of maleic anhydride moiety.

16. The composition of claim 12 wherein (iii) is a hydrocarbyl substituted succinic acid or anhydride in which the hydrocarbyl substituent is an alkenyl or alkyl group derived from a polymer of $C_2$ to $C_5$ mono-olefin.

17. The composition of claim 16 wherein the carboxylic acid is polyisobutenyl succinic anhydride having about 50 to 400 carbon atoms in the polyisobutenyl group.

18. The composition of claim 12 wherein the amine is alkylene polyamine of the general formula $$H_2N\text{-}(\text{alkylene}-NH)_x\text{-}H$$

wherein x is about 1 to 10 and the alkylene radical is ethylene.

19. The composition of claim 12 which comprises the reaction product of 5 to 30 wt. % of the ethylene copolymer in 95 to 70 wt. % of a mineral lubricating oil, free radical grafted with maleic anhydride whereby both the copolymer and some oil have become reacted with maleic anhydride, then reacting with a mixture of diethylene triamine and polyisobutenyl succinic anhydride having 50 to 400 carbons in said polyisobutenyl substituent.

20. The composition of claim 12 which is the reaction product of 5 to 30 wt. % of ethylene-propylene copolymer in 95 to 70 wt. % mineral lubricating oil free radical grafted with maleic anhydride using a free radical peroxide initiator, and further reacted with an ashless dispersant reaction product of about 1 to 2 moles polyisobutenyl succinic anhydride having 50 to 400 carbons in said polyisobutenyl substituent with a molar proportion of diethylene triamine.

21. The composition of claim 20 which is finally treated with an alkyl benzene sulfonic acid having an average of about 24 carbons in said alkyl group.

22. The composition of claim 12 wherein 5 to 30 wt. % of ethylene-propylene copolymer in 95 to 70 wt. % mineral lubricating oil is free radical grafted with maleic anhydride using a peroxide initiator, and is then simultaneously reacted with diethylene triamine and polyisobutenyl succinic anhydride.

23. The composition of claim 4 wherein the thickener in (b) is present in an amount ranging from about 6 to about 12 wt. %, the copolymers in (c) and (d) are each present in an amount ranging from about 0.1 to about 2 wt. %, and polyisoprene is present in an amount ranging from about 0.1 to about 0.2 wt. %.

24. A grease composition comprising (a) from above about 50 to about 90 wt. % of a lubricating oil, (b) from about 6 to about 12 wt. % of a thickener based on a lithium soap, a calcium soap, their complexes, or mixtures thereof, (c) from about 0.1 to about 2 wt. % of a copolymer of ethylene and at least one other alphaolefin monomer, wherein the copolymer comprises intramolecularly heterogeneous copolymer chains containing at least one crystallizable segment of the methylene units and at least one low crystallinity ethylene-alphaolefin copolymer segment, wherein said at least one crystallizable segment comprises at least about 10 wt. % of said copolymer chain and contains an average ethylene content of at least about 57 wt. %, wherein said low crystallinity segment contains an average ethylene content not greater than about 53 wt. %, and wherein said copolymer has a molecular weight distribution characterized by at least one of a ratio of $\overline{M}_w/\overline{M}_n$ of less than 1.5 and a ratio of $\overline{M}_z/\overline{M}_w$ of less than 1.5 and wherein at least two portions of an individual intramolecularly heterogeneous chain, each portion comprising at least 5 wt. % of said chain, differ in composition from one another by at least 10 wt. % ethylene, (d) from about 0.1 to about 2 wt. % of a copolymer which comprises the reaction product of (i) an ethylene copolymer comprising from about 15 to about 90 wt. % ethylene and from about 10 to about 85 wt. % of one or more $C_3$ to $C_8$ alphaolefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;

(ii) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and, (iii) a long chain hydrocarbyl substituted succinic anhydride or acid having 50 to 400 carbon atoms, and (e) from about 0.1 to about 0.4 wt. % polyisoprene.

25. The composition of claim 24 wherein the polyisoprene is present in an amount ranging from about 0.1 to about 0.2 wt. %.

26. The composition of claim 25 wherein the thickener is a lithium soap or a lithium complex soap based on an hydroxy fatty acid having from 12 to 24 carbon atoms.

27. The composition of claim 26 wherein the hydroxy fatty acid comprises an hydroxy stearic acid.

28. The composition of claim 27 wherein the hydroxy stearic acid comprises 12-hydroxy stearic acid.

29. The composition of claim 24 wherein (A) comprises a copolymer containing from about 30 to about 80 wt. % ethylene and from about 20 to about 70 wt. % propylene, having a number average molecular weight in the range of about 10,000 to 200,000 grafted with maleic anhydride.

30. The composition of claim 29 wherein (A) comprises ethylene and propylene grafted with maleic anhydride, wherein about 1 to 2 molar proportions of (B) and about 1 to 4 molar proportions of (C) are used per molar proportion of maleic anhydride moiety.

31. The composition of claim 24 which is the reaction product of 5 to 30 wt. % of ethylene-propylene copolymer in 95 to 70 wt. % mineral lubricating oil free radical grafted with maleic anhydride using a free radical peroxide initiator, and further reacted with an ashless dispersant reaction product of about 1 to 2 moles polyisobutenyl succinic anhydride having 50 to 400 carbons in said polyisobutenyl substituent with a molar proportion of diethylene triamine.

32. The composition of claim 24 wherein 5 to 30 wt. % of ethylene-propylene copolymer in 95 to 70 wt. % mineral lubricating oil is free radical grafted with maleic anhydride using a peroxide initiator, and is then simultaneously reacted with diethylene triamine and polyisobutenyl succinic anhydride.

33. The composition of claim 24 wherein the copolymer in (c) has a molecular weight distribution characterized by at least one of a ratio of $\overline{M}_w/\overline{M}_n$ of less than about 1.25 and a ratio of $\overline{M}_z/\overline{M}_w$ of less than about 1.2.

34. The composition of claim 24 wherein the copolymer in (c) has a molecular weight distribution characterized by both of a ratio of $\overline{M}_w/\overline{M}_w$ of less than about 1.25 and a ratio of $\overline{M}_z/\overline{M}_w$ of less than about 1.2.

35. A method for increasing the water resistance of a grease composition containing (a) from above about 50 to about 90 wt. % of a lubricating oil, and (b) from about 1 to about 15 wt. % of a water insoluble thickener, which comprises adding to said composition (i) from about 0.01 to about 4 wt. % of a copolymer of ethylene and at least one other alpha-olefin monomer, wherein the copolymer comprises intramolecularly heterogeneous copolymer chains containing at least one crystallizable segment of the methylene units and at least one low crystallinity ethylene-alphaolefin copolymer segment, wherein said at least one crystallizable segment comprises at least abut 10 wt. % of said copolymer chain and contains an average ethylene content of at least about 57 wt. %, wherein said low crystallinity segment contains an average ethylene content not greater than about 53 wt. %, and wherein said copolymer has a molecular weight distribution characterized by at least one of a ratio of $\overline{M}_w/\overline{M}_n$ of less than 2 and a ratio of $\overline{M}_z/\overline{M}_w$ of less than 1.8, and wherein at least two portions of an individual intramolecularly heterogeneous chain, each portion comprising at least 5 wt. % of said chain, differ in composition from one another by at least 7 wt. % ethylene, and (ii) from about 0.01 to about 4 wt. % of a copolymer which comprises the reaction product of (A) an ethylene copolymer comprising from about 15 to about 90 wt. % ethylene and from about 10 to about 85 wt. % of one or more $C_3$ and $C_{28}$ alpha-olefin wherein the copolymer has a number average molecular weight ranging from about 5,000 to about 500,000 and is grafted with an ethylenically unsaturated carboxylic acid material containing at least one ethylenic bond and at least one carboxylic acid groups or anhydride groups;

(B) an alkylene or oxyalkylene amine having at least two primary amine groups selected from the group consisting of alkylene polyamines having alkylene groups of about 2 to 7 carbon atoms and 2 to 11 nitrogens, and polyoxyalkylene polyamines, wherein the alkylene groups contain 2 to 7 carbon atoms and the number of oxyalkylene groups will be about 3 to 70; and (C) a long chain hydrocarbyl substituted succinic anhydride or acid having 50 to 400 carbons atoms.

36. The method of claim 35 wherein the thickener is based on a lithium soap, a calcium soap, their complexes, or mixtures thereof.

37. The method of claim 36 wherein the thickener is a lithium soap or a lithium complex soap based on an hydroxy fatty acid.

38. The method of claim 37 wherein a pure hydrocarbon solvent, a mixed hydrocarbon solvent, a chlorohydrocarbon solvent, or mixtures thereof is added to the lubricating composition.

* * * * *